US011348520B2

(12) United States Patent
Kim et al.

(10) Patent No.: US 11,348,520 B2
(45) Date of Patent: May 31, 2022

(54) ORGANIC LIGHT EMITTING DISPLAY DEVICE AND DRIVING METHOD THEREOF

(71) Applicant: LG Display Co., Ltd., Seoul (KR)

(72) Inventors: Jae-Sung Kim, Uijeongbu-si (KR); Ki-Woo Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/122,206

(22) Filed: Dec. 15, 2020

(65) Prior Publication Data

US 2021/0201798 A1 Jul. 1, 2021

(30) Foreign Application Priority Data

Dec. 27, 2019 (KR) ..... 10-2019-0176135

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0297* (2013.01); *G09G 2310/08* (2013.01); *G09G 2320/103* (2013.01); *G09G 2330/021* (2013.01); *G09G 2340/0435* (2013.01)

(58) Field of Classification Search
CPC .. G09G 3/3258; G09G 3/3291; G09G 3/3266; G09G 2310/08; G09G 2310/0297; G09G 2310/061; G09G 2310/0262; G09G 2340/0435; G09G 2330/028; G09G 2310/0202; G09G 2330/021; G09G 2300/0809; G09G 3/3233
See application file for complete search history.

(56) References Cited

U.S. PATENT DOCUMENTS 9,182,805 B2 * 11/2015 Kim ..... G06F 1/3265
2002/0036626 A1 * 3/2002 Tsutsui ..... G09G 3/3659 345/204
2003/0234758 A1 * 12/2003 Bu ..... G09G 3/3648 345/90
2005/0140596 A1 * 6/2005 Lee ..... G09G 3/3233 345/76
2008/0180365 A1 * 7/2008 Ozaki ..... G09G 3/3233 345/76

(Continued)

FOREIGN PATENT DOCUMENTS

KR 10-2011-0011940 A 2/2011

*Primary Examiner* — Michael J Eurice
(74) *Attorney, Agent, or Firm* — Fenwick & West LLP

(57) ABSTRACT

An organic light emitting display device includes a display panel including a plurality of pixels each including an organic light emitting diode, a gate driver configured to supply a gate driving signal to each of the pixels, a data driver configured to supply a data voltage to each of the pixels, a multiplexer being switched in response to an external control signal to output any one of the data voltage and a voltage supplied from a separate power supply line, and a timing controller configured to control the multiplexer to transfer the data voltage to a data line of each of the pixels in a refresh period in a low-speed driving mode and transfer the voltage from the separate power supply line to the data line of each of the pixels for at least one anode reset period in a hold period in the low-speed driving mode.

10 Claims, 8 Drawing Sheets

(56) References Cited

U.S. PATENT DOCUMENTS

| | | | | |
|---|---|---|---|---|
| 2009/0109158 | A1* | 4/2009 | Shirai | G09G 3/3688 345/94 |
| 2011/0025678 | A1* | 2/2011 | Chung | G09G 3/3233 345/213 |
| 2012/0105404 | A1* | 5/2012 | Gotoh | G06F 3/0412 345/207 |
| 2013/0002641 | A1* | 1/2013 | Kim | G06F 1/3265 345/212 |
| 2013/0057530 | A1* | 3/2013 | Han | G09G 3/3696 345/211 |
| 2014/0160185 | A1* | 6/2014 | Okuno | G09G 3/3233 345/691 |
| 2015/0187268 | A1* | 7/2015 | Tani | G09G 3/3233 345/77 |
| 2015/0188431 | A1* | 7/2015 | Cho | H02M 3/158 345/212 |
| 2019/0121476 | A1* | 4/2019 | Jang | G06F 3/0412 |
| 2020/0074931 | A1* | 3/2020 | Yang | G09G 3/3266 |
| 2020/0372853 | A1* | 11/2020 | Park | G09G 3/3233 |
| 2021/0020137 | A1* | 1/2021 | Jang | G09G 3/3688 |

* cited by examiner

ORGANIC LIGHT EMITTING DISPLAY DEVICE AND DRIVING METHOD THEREOF

CROSS-REFERENCE TO RELATED APPLICATIONS

This application claims the benefit of Republic of Korea Patent Application No. 10-2019-0176135, filed on Dec. 27, 2019, which is hereby incorporated by reference in its entirety.

BACKGROUND

Field of Technology

The present Disclosure relates to an organic light emitting display (OLED) device and a driving method thereof, and more particularly, to an OLED device which is capable of reducing degradation in picture quality when driven at a low speed, and a driving method thereof.

Discussion of the Related Art

In an information dependent society, a number of techniques related to the field of a display device which displays visual information as an image or a picture have been developed. An electroluminescent display device among display devices displays a picture using a light emitting element which generates light by recombination of electrons and holes. The electroluminescent display device may be implemented as an organic light emitting display (OLED), a quantum dot display, a μ-LED display, or the like. Here, the OLED has been spotlighted as a next-generation display device in that it has a fast response speed and is capable of achieving low grayscale expression according to self-emission.

Provided that there is little input image variation in such a display device, pixels may be driven at a low speed to reduce power consumption of the display device. Although a variety of low-speed driving methods have been proposed, they may suffer a picture quality degradation problem. For example, in low-speed driving, the voltages of pixels may be discharged, thereby causing a user to feel a flicker phenomenon in which the luminances of the pixels are changed at a data update period. Therefore, there is a need for a scheme capable of solving a picture quality degradation problem in low-speed driving of a display device.

SUMMARY

Accordingly, the present disclosure is directed to an organic light emitting display (OLED) device and a driving method thereof that substantially obviate one or more problems due to limitations and disadvantages of the related art.

An object of the present disclosure is to provide an OLED device which is capable of reducing a flicker phenomenon when driven at a low speed, and a driving method thereof.

Another object of the present disclosure is to provide an OLED device which is capable of solving a power consumption degradation problem caused when a data voltage is set to a predetermined voltage for improvement in picture quality, and a driving method thereof.

Another object of the present disclosure is to provide an OLED device which is capable of improving power consumption by supplying a currently used voltage to a data line for an anode reset period in low-speed driving to set a data voltage to a predetermined voltage, and a driving method thereof.

A further object of the present disclosure is to provide an OLED device which is capable of being used for an anode reset period in low-speed driving without being limited in data range, and a driving method thereof.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the disclosure, as embodied and broadly described herein, an organic light emitting display device includes a display panel configured to display an image and including a plurality of pixels each including an organic light emitting diode configured to emit light with a brightness corresponding to the amount of driving current, a gate driver configured to supply a gate driving signal to each of the pixels, a data driver configured to supply a data voltage to each of the pixels, a multiplexer being switched in response to an external control signal to output any one of the data voltage and a voltage supplied from a separate power supply line, and a timing controller configured to control the multiplexer to transfer the data voltage to a data line of each of the pixels in a refresh period in a low-speed driving mode and transfer the voltage from the separate power supply line to the data line of each of the pixels for at least one anode reset period in a hold period in the low-speed driving mode.

The multiplexer may include a first switching element being switched to supply the data voltage to the data line of each of the pixels for the refresh period, and a second switching element being switched to supply the voltage from the separate power supply line to the data line of each of the pixels for the anode reset period.

The multiplexer may be disposed in the data driver or between the data driver and the display panel.

The voltage transferred to the date line of each of the pixels for the anode reset period may be a high-level voltage greater than the data voltage.

In another aspect of the present invention, a driving method of an organic light emitting display device includes determining whether to drive a display panel in a general driving mode or a low-speed driving mode, supplying a data voltage to a data line of each pixel of the display panel in a refresh period in the low-speed driving mode, and supplying a voltage from a separate power supply line to the data line of each pixel for at least one anode reset period in a hold period in the low-speed driving mode.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
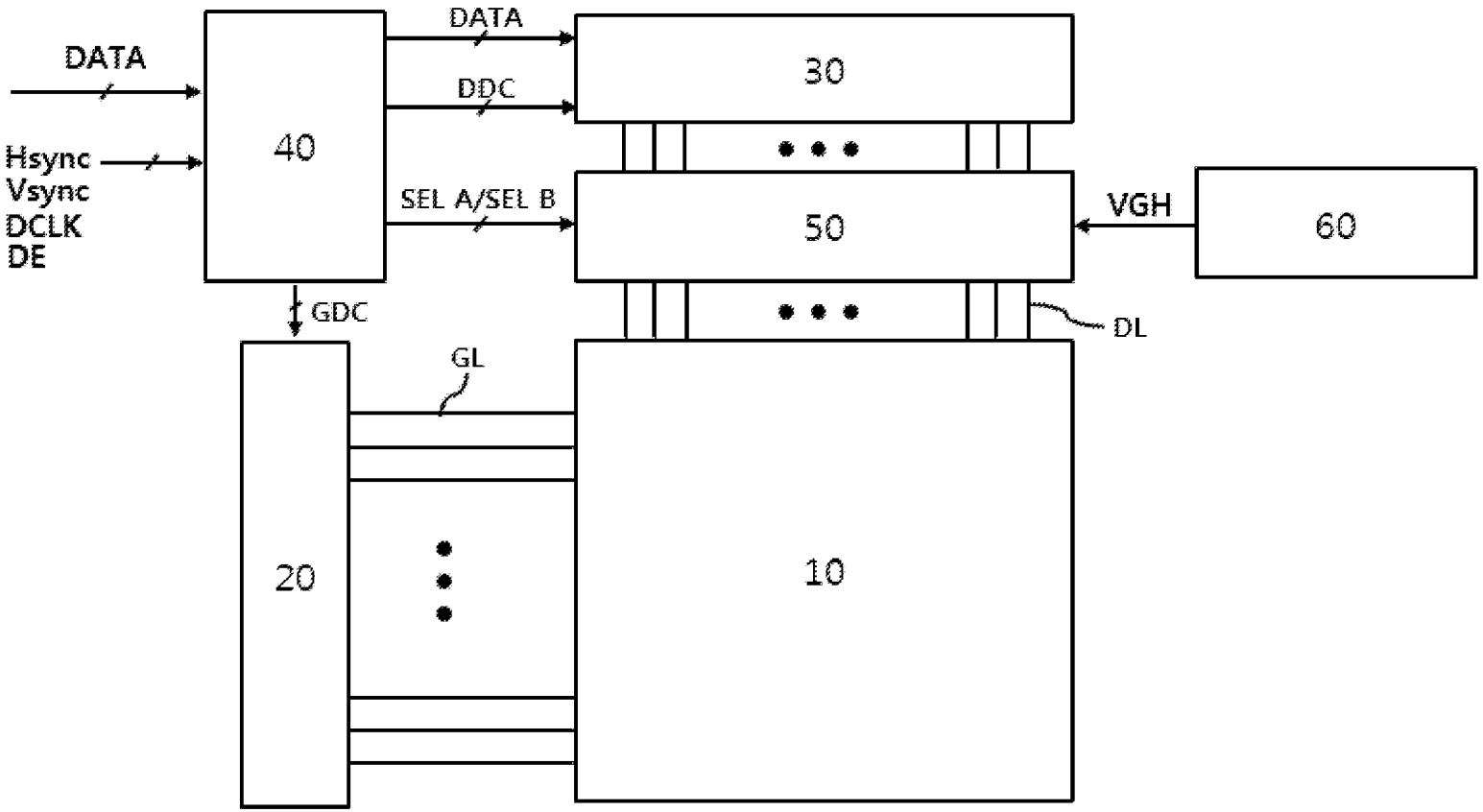
FIG. 1 is a block diagram schematically showing the configuration of an organic light emitting display (OLED) device according to an embodiment of the present disclosure.

For embodiments of the present invention disclosed in the description, specific structural and functional descriptions are exemplified for the purpose of describing embodiments of the present invention, and embodiments of the present invention can be implemented in various forms and are not to be considered as a limitation of the invention.

The present invention can be modified in various manners and have various forms and specific embodiments will be described in detail with reference to the drawings. However, the disclosure should not be construed as limited to the embodiments set forth herein, but on the contrary, the disclosure is to cover all modifications, equivalents, and alternatives falling within the spirit and scope of the present invention.

While terms, such as "first", "second", etc., may be used to describe various components, such components must not be limited by the above terms. The above terms are used only to distinguish one component from another. For example, a first component may be referred to as a second component and the second component may be referred to as the first component without departing from the scope of the present invention.

When an element is "coupled" or "connected" to another element, it should be understood that a third element may be present between the two elements although the element may be directly coupled or connected to the other element. When an element is "directly coupled" or "directly connected" to another element, it should be understood that no element is present between the two elements. Other representations for describing a relationship between elements, that is, "between", "immediately between", "in proximity to", "in direct proximity to" and the like should be interpreted in the same manner.

The terms used in this specification are merely used in order to describe particular embodiments, and are not intended to limit the scope of the present invention. An element described in the singular form is intended to include a plurality of elements unless the context clearly indicates otherwise. In this specification, it will be further understood that the terms "comprise" and "include" specify the presence of stated features, integers, steps, operations, elements, components, and/or combinations thereof, but do not preclude the presence or addition of one or more other features, integers, steps, operations, elements, components, and/or combinations.

Unless otherwise defined, all terms including technical and scientific terms used herein have the same meaning as commonly understood by one of ordinary skill in the art to which the present invention pertains. It will be further understood that terms, such as those defined in commonly used dictionaries, should be interpreted as having a meaning that is consistent with their meaning in the context of the related art and should not be interpreted in an idealized or overly formal sense unless expressly so defined herein.

Meanwhile, when a certain embodiment can be implemented in a different manner, a function or an operation specified in a specific block may be performed in a different sequence from that specified in a flowchart. For example, two consecutive blocks may be simultaneously executed or reversely executed according to a related function or operation.

In the following description, a pixel circuit and a gate driving circuit formed on a substrate of a display panel may be implemented with n-type or p-type transistors. For example, a transistor may be implemented with a transistor of a metal oxide semiconductor field effect transistor (MOSFET) structure. The transistor is a three-electrode element including a gate, a source and a drain. The source is an electrode that supplies carriers to the transistor. In the transistor, carriers start to flow from the source. The drain is an electrode through which carriers externally flow in the transistor. For example, carriers flow from the source to the drain in the transistor. In the case of the n-type transistor, carriers are electrons and thus a source voltage is lower than a drain voltage such that the electrons flow from the source to the drain. Since electrons flow from the source to the drain in the n-type transistor, current flows from the drain to the source. In the case of the p-type transistor, carriers are holes and thus a source voltage is greater than a drain voltage such that the holes flow from the source to the drain. Since holes flow from the source to the drain in the p-type transistor, current flows from the source to the drain. The source and the drain of a transistor are not fixed and may be interchanged according to voltages applied thereto.

In the following description, a gate on voltage may be a voltage of a gate driving signal capable of turning on a transistor. A gate off voltage may be a voltage capable of turning off the transistor. In the p-type transistor, the gate on voltage may be a low logic voltage VL and the gate off voltage may be a high logic voltage VH. In the n-type transistor, the gate on voltage may be the high logic voltage VH and the gate off voltage may be the low logic voltage VL.

Hereinafter, an organic light emitting display (OLED) device and a driving method thereof according to the present invention will be described with reference to the annexed drawings.

FIG. 1 is a block diagram schematically showing the configuration of an OLED device according to the present disclosure. As shown in FIG. 1, the OLED device includes a display panel 10 configured to display an image and including a plurality of pixels each including an organic light emitting diode EL (shown in FIG. 4) configured to emit light with a brightness corresponding to the amount of driving current, a gate driver 20 configured to supply a gate driving signal to each of the pixels, a data driver 30 configured to supply a data voltage to each of the pixels, a multiplexer 50 being switched in response to an external control signal to output any one of the data voltage and a voltage supplied from a separate power supply line, and a timing controller 40 configured to control the multiplexer 50 to transfer the data voltage from the data driver 30 to each of the pixels of the display panel 10 in a refresh period in a low-speed driving mode and transfer the voltage from the separate power supply line to each of the pixels of the display panel 10 for at least one anode reset period in a hold period in the low-speed driving mode.

A high-level voltage, such as VGH, is supplied from a power supply 60 to the multiplexer 50.

Touch sensors may be disposed in the display panel 10. A touch sensor driver may be controlled such that a driving frequency and power consumption thereof in the low-speed driving mode are lower than those in a basic driving mode. In the case of a mobile device, a display panel driving circuit and the timing controller 40 may be integrated into one drive integrated circuit (IC).

The display panel driving circuit may operate in the low-speed driving mode. When an input image is analyzed and there is no variation in the input image by a predetermined number of frames as a result of the analysis, the low-speed driving mode may be set to reduce power consumption of the display device. In other words, the low-speed driving mode is set to, when a still image is input for a predetermined time or more, lower a refresh rate of pixels to lengthen a data write period of the pixels, so as to reduce power consumption.

The low-speed driving mode is not limited to when a still image is input. For example, when the display device operates in a standby mode or when a user command or an input image is not input to the display panel driving circuit for a predetermined time or more, the display panel driving circuit may operate in the low-speed driving mode.

In the basic driving mode, the data driver 30 converts digital data DATA of an input image received from the timing controller 40 every frame into a data voltage and supplies the data voltage to each data line. The data driver 30 outputs the data voltage using a digital to analog converter (DAC) which converts the digital data into a gamma compensation voltage. In the low-speed driving mode, the data driver 30 is lowered in driving frequency by the timing controller 40. For example, in the basic driving mode, the data driver 30 may output a data voltage of an input image every frame period. In the low-speed driving mode, the data driver 30 may output a data voltage of an input image in some frame periods and generate no output in the remaining frame periods. As a result, the driving frequency and power consumption of the data driver 30 in the low-speed driving mode are much lower than those in the basic driving mode.

The gate driver 20 outputs scan pulses SCAN1 and SCAN2 and an EM signal under control of the timing controller 40 to select pixels to be charged with data voltages through gate lines GL and adjust a light emission timing.

In the low-speed driving mode, the gate driver 20 is lowered in driving frequency by the timing controller 40. As a result, the driving frequency and power consumption of the gate driver 20 in the low-speed driving mode are much lower than those in the basic driving mode.

The timing controller 40 receives digital video data DATA of an input image and timing signals synchronized therewith from a host system, not shown. The timing signals include a vertical synchronous signal Vsync, a horizontal synchronous signal Hsync, a clock signal DCLK, and a data enable signal DE. The host system may be any one of a television (TV) system, a set-top box, a navigation system, a digital video disk (DVD) player, a Blu-ray player, a personal computer (PC), a home theater system, and a phone system.

The timing controller 40 includes a low-speed driving control module which lowers the driving frequency of the display panel driving circuit. It should be noted that the low-speed driving mode is not limited to only a still image, as stated above.

The timing controller 40 generates a data timing control signal DDC for control of the operation timing of the data driver 30, control signals SEL A and SEL B for control of the operation timing of the multiplexer 50 and a gate timing control signal GDC for control of the operation timing of the gate driver 20 based on the timing signals Vsync, Hsync and DE received from the host system.

The data timing control signal DDC includes a source start pulse SSP, a source sampling clock SSC, a polarity control signal POL, and a source output enable signal SOE. The source start pulse SSP controls the sampling start timing of the data driver 20. The source sampling clock SSC is a clock which shifts a data sampling timing. The polarity control signal POL controls the polarity of a data signal output from the data driver 30. Provided that a signaling interface between the timing controller 40 and the data driver 30 is a mini Low Voltage Differential Signaling (LVDS) interface, the source start pulse SSP and the source sampling clock SSC may be omitted.

The gate timing control signal GDC includes a gate start pulse VST, a gate shift clock CLK, and a gate output enable signal GOE. In the case of a Gate-In-Panel (GIP) circuit, the gate output enable signal GOE may be omitted.

Although the multiplexer 50 is shown in this drawing as being disposed between the data driver 30 and the display panel 10, it may be included in the data driver 30.

Figure 2:
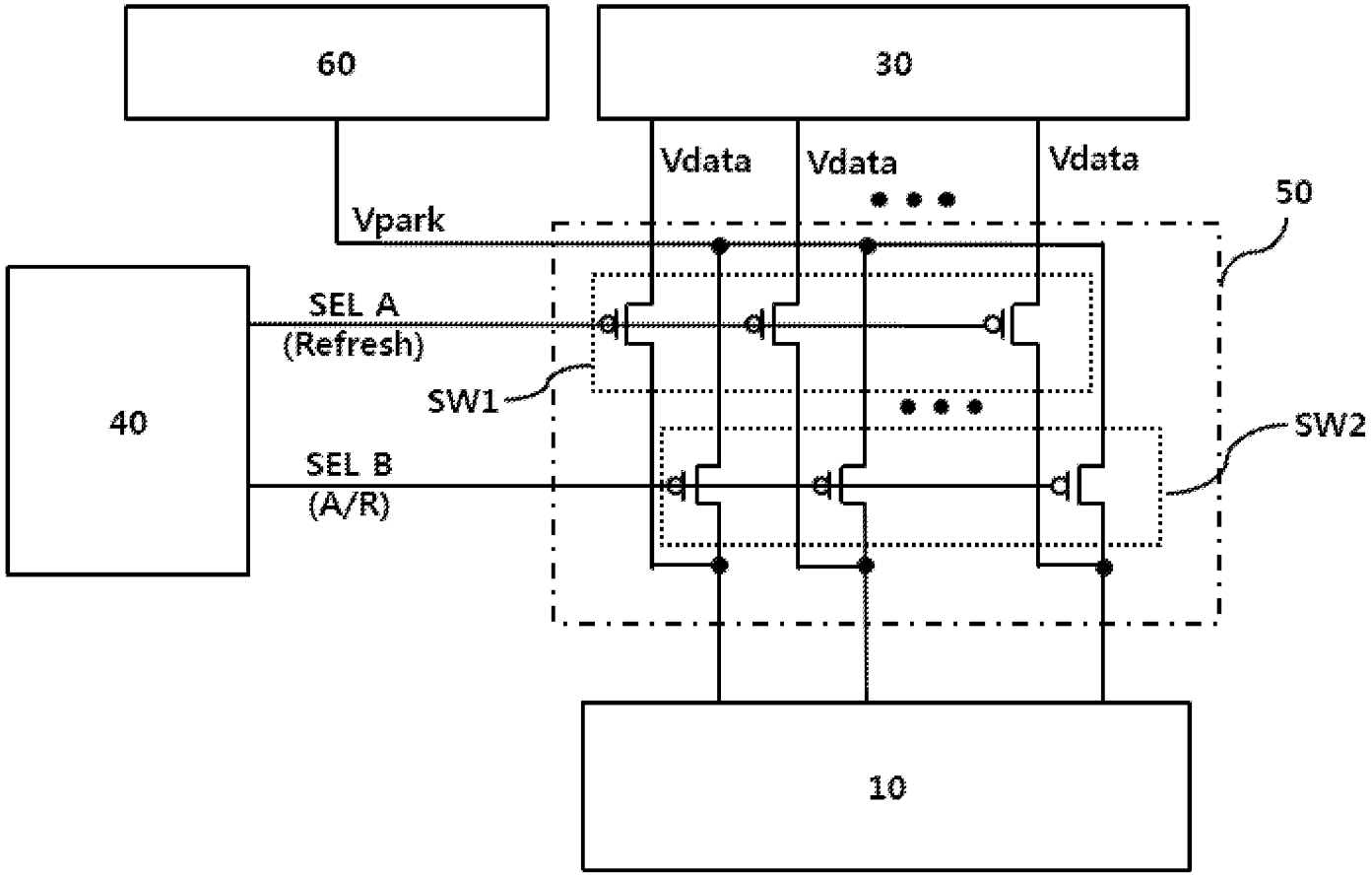
FIG. 2 is a detailed diagram of a multiplexer in FIG. 1 according to an embodiment of the present disclosure.

FIG. 2 is a detailed diagram of the multiplexer in FIG. 1. As shown in FIG. 2, the multiplexer 50 includes a first switching element SW1 being switched to supply a data voltage to a data line of each pixel for the refresh period, and a second switching element SW2 being switched to supply a voltage (for example, VGH) Vpark, provided from the power supply 60 through the separate power supply line, to the data line of each pixel for the anode reset period.

Figure 3:
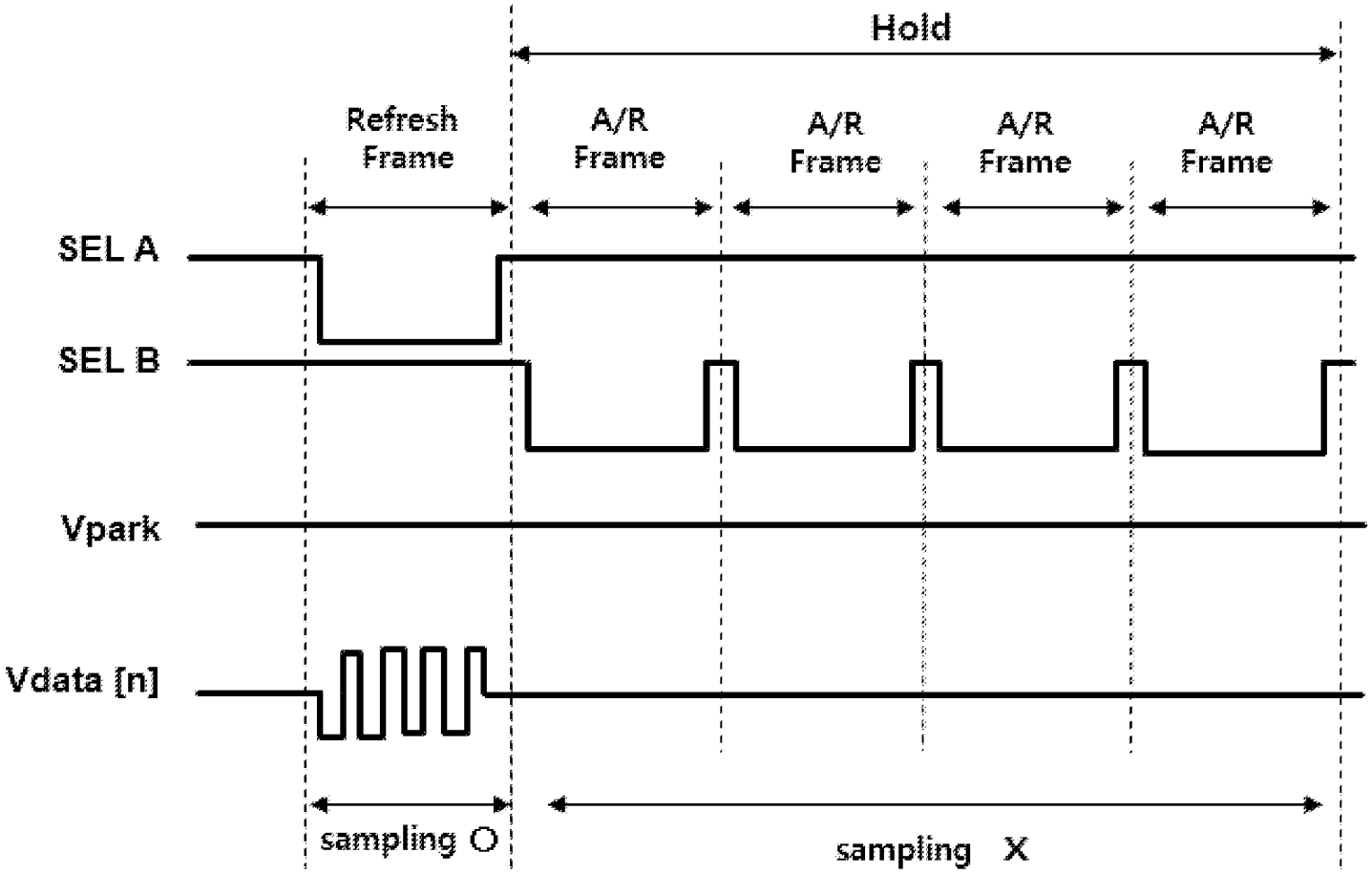
FIG. 3 is a waveform diagram of output signals from a timing controller and output signals from the multiplexer in a low-speed driving mode of the OLED device according to an embodiment of the present disclosure.

FIG. 3 is a waveform diagram of output signals from the timing controller and output signals from the multiplexer in the low-speed driving mode of the OLED device according to the present disclosure. As shown in FIG. 3, the timing controller 40 outputs a signal SEL A for driving of the first switching element SW1 for a refresh frame period. The first switching element SW1 includes a plurality of first switching elements SW1. As a result, a low logic voltage, which is a gate on voltage, is provided to the gate electrode of each of the plurality of first switching elements SW1 to turn on each first switching element SW1, thereby causing a data voltage Vdata to be supplied to the data line of each pixel. If the refresh frame period is finished, a hold frame period in which a sampling operation of writing a data voltage supplied to a data line in a pixel every unit time is not performed is started. For the hold frame period, a charged data voltage is held until the refresh period of the next frame is started.

The timing controller 40 outputs a signal SEL B for driving of the second switching element SW2 for an anode reset frame (A/R frame) period. The second switching element SW2 includes a plurality of second switching elements SW2. As a result, the low logic voltage, which is the gate on voltage, is provided to the gate electrode of each of the plurality of second switching elements SW2 to turn on each second switching element SW2, thereby causing the voltage Vpark supplied through the separate power supply line to be supplied to the data line of each pixel. The voltage Vpark, supplied to the data line of each pixel for the anode reset period, may be a high-level voltage VGH greater than the data voltage Vdata. For provision of the corresponding voltage by the data driver 30, it is necessary to raise an output data range of the data driver 30, resulting in increases in power consumption and manufacturing cost. However, according to the present disclosure, power consumption may be improved by supplying a currently used voltage (for example, VGH) to the data line for the anode reset period in the low-speed driving mode.

Figure 4:
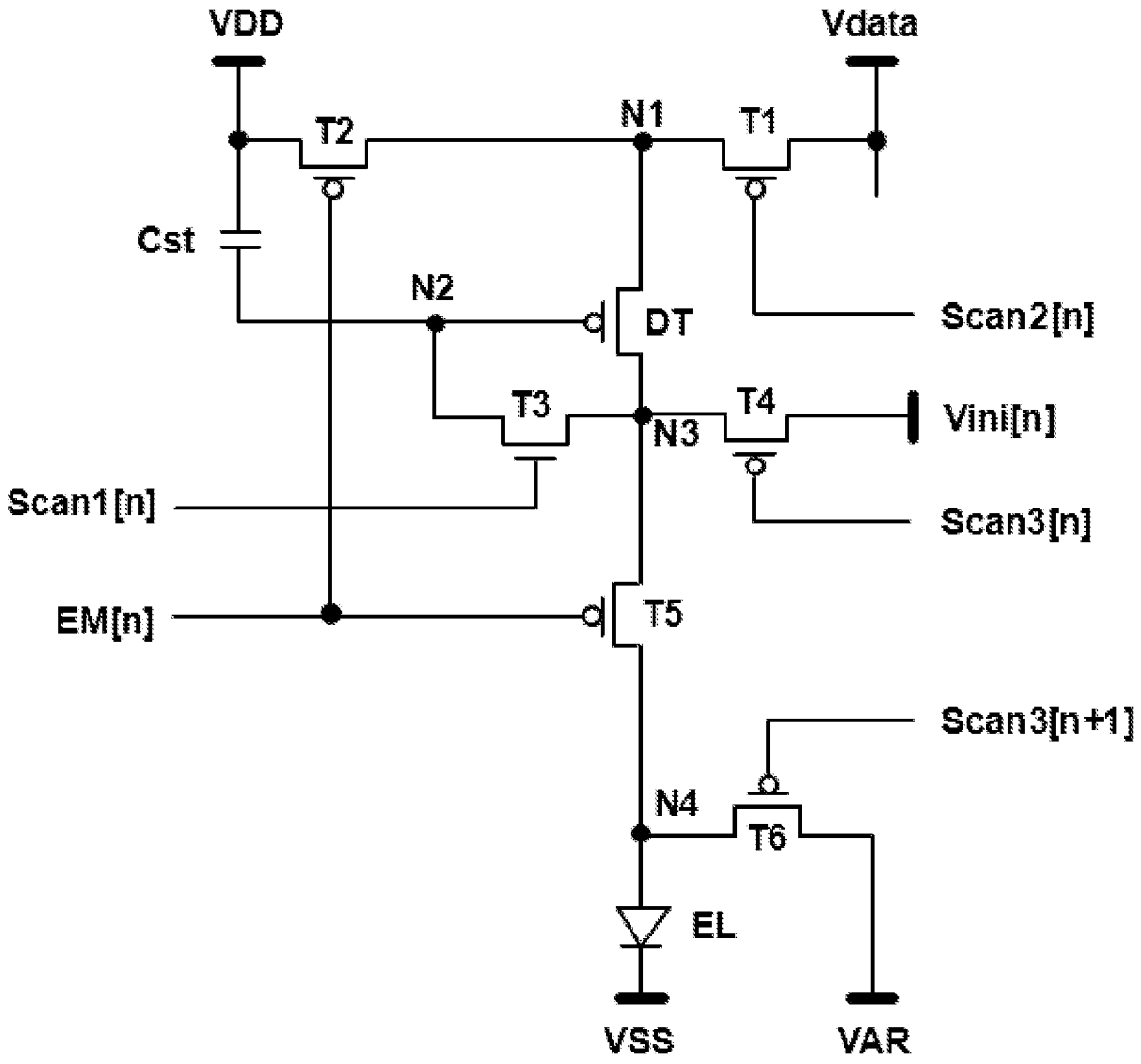
FIG. 4 is a circuit diagram of a pixel of the OLED device according to an embodiment of the present disclosure.

FIG. 4 is a circuit diagram of a pixel of the OLED device according to the present disclosure. The pixel includes first to sixth switching transistors T1 to T6, a driving transistor DT, a capacitor Cst, and an organic light emitting diode EL. Each of the first and second switching transistors T1 and T2, fourth to sixth switching transistors T4 to T6 and driving transistor DT of the pixel is a p-type transistor which is turned on in response to a low logic voltage provided as a gate on voltage. The third switching transistor T3 of the pixel is an n-type transistor which is turned on in response to a high logic voltage provided as the gate on voltage.

Active layers which constitute the driving transistor and the switching transistors, respectively, may be made of the same material or different materials. Provided that the driving transistor and the switching transistors in one pixel driving circuit have different characteristics, the OLED device may include a multi-type transistor.

In detail, in the OLED device including the multi-type transistor, a Low Temperature Poly-Silicon (LTPS) transistor employing LTPS is used as a transistor having an active layer made of a poly-silicon semiconductor material. The poly-silicon material is low in energy consumption and excellent in reliability in that it has a high mobility (100 $cm^2/Vs$ or more). In this regard, the poly-silicon material may be applied to the gate driver 20 and/or the multiplexer 50 for a driving element driving transistors for a display element. Alternatively, the poly-silicon material may be applied to a driving transistor in a pixel of the OLED device.

In addition, in the OLED device including the multi-type transistor, an oxide semiconductor transistor having an active layer made of an oxide semiconductor material is used. Because the oxide semiconductor material has low off-current, it may be appropriate for a switching transistor having a short turn-on time and a long turn-off time. The oxide semiconductor transistor has a voltage holding characteristic better than that of the LTPS transistor.

For example, an OLED device including a multi-type transistor according to an embodiment of the present invention may include a pixel driving circuit including a switching transistor which is an oxide semiconductor transistor and a driving transistor which is an LTPS transistor. Noticeably, in the OLED device of the present invention, the switching transistor is not limited to the oxide semiconductor transistor and the driving transistor is not limited to the LTPS transistor, and the multi-type transistor may be implemented in various ways.

Scan signals Scan1[*n*], Scan2[*n*] and Scan3[*n*] provided to the pixel are provided from an nth stage of a shift register in the gate driver 20, and a scan signal Scan3 [*n*+1] provided to the pixel is provided from an (n+1)th stage of the shift register.

The gate electrode of the first switching transistor T1 receives the second scan signal Scan2[*n*] from the nth stage. The source electrode of the first switching transistor T1 is supplied with the data voltage Vdata. The drain electrode of the first switching transistor T1 is connected to the source electrode of the driving transistor DT. The first switching transistor T1 is turned on by the second scan signal Scan2[*n*] to supply the data voltage Vdata to the source electrode of the driving transistor DT.

The gate electrode of the second switching transistor T2 receives a light emission control signal EM[n] from the nth stage. The source electrode of the second switching transistor T2 is supplied with a high-level driving voltage VDD. The drain electrode of the second switching transistor T2 is connected to the source electrode (first node N1) of the driving transistor DT. The second switching transistor T2 is turned on by the light emission control signal EM[n] to supply the high-level driving voltage VDD to the source electrode of the driving transistor DT.

The gate electrode of the third switching transistor T3, which is an n-type transistor, receives the first scan signal Scan1 [n] from the nth stage. The source electrode of the third switching transistor T3 is connected to the drain electrode of the driving transistor DT. The drain electrode of the third switching transistor T3 is connected to the gate electrode of the driving transistor DT. The gate electrode of the driving transistor DT is connected to a second node N2. The third switching transistor T3 is turned on by the first scan signal Scan1[*n*] to control a voltage difference between the gate electrode and drain electrode of the driving transistor DT so as to drive the driving transistor DT.

The gate electrode of the fourth switching transistor T4 receives the third scan signal Scan3[*n*] from the nth stage. The source electrode of the fourth switching transistor T4 receives an initialization voltage Vini. The drain electrode of the fourth switching transistor T4 is connected to the drain electrode of the driving transistor DT and the source electrode of the third switching transistor T3. The drain electrode of the driving transistor DT is connected to a third node N3. The fourth switching transistor T4 is turned on by the third scan signal Scan3[*n*] to supply the initialization voltage Vini to the drain electrode of the driving transistor DT.

The gate electrode of the fifth switching transistor T5 receives the light emission control signal EM[n] from the nth stage. The source electrode of the fifth switching transistor T5 is connected to the drain electrode of the driving transistor DT. The drain electrode of the fifth switching transistor T5 is connected to an anode electrode of the light emitting diode EL. The fifth switching transistor T5 is turned on by the light emission control signal EM[n] to provide driving current to the anode electrode of the light emitting diode EL.

The gate electrode of the sixth switching transistor T6 receives the third scan signal Scan3[*n*+1] from the (n+1)th stage. The source electrode of the sixth switching transistor T6 receives a variable anode reset voltage VAR. The drain electrode of the sixth switching transistor T6 is connected to the anode electrode of the light emitting diode EL. The anode electrode of the light emitting diode EL is connected to a fourth node N4. The sixth switching transistor T6 is turned on by the third scan signal Scan3[*n*+1] from the (n+1)th stage to supply the anode reset voltage VAR to the anode electrode of the light emitting diode EL.

The gate electrode of the driving transistor DT is connected to the drain electrode of the third switching transistor T3. The drain electrode of the driving transistor DT is connected to the source electrode of the third switching transistor T3. The source electrode of the driving transistor DT is connected to the first node N1 at which the drain electrode of the first switching transistor T1 and the drain electrode of the second switching transistor T2 are connected to each other. The drain electrode of the driving transistor DT is also connected to the source electrode of the fifth switching transistor T5. The driving transistor DT is turned on by a voltage difference between the drain electrode thereof and the drain electrode of the third switching transistor T3 to supply the driving current to the light emitting diode EL.

The capacitor Cst receives the high-level driving voltage VDD at one electrode thereof. The capacitor Cst is connected to the gate electrode of the driving transistor DT at the other electrode thereof. The capacitor Cst stores a voltage of the gate electrode of the driving transistor DT.

The anode electrode of the light emitting diode EL is connected to the fourth node N4 at which the drain electrode of the fifth switching transistor T5 and the drain electrode of the sixth switching transistor T6 are connected to each other. The cathode electrode of the light emitting diode EL receives a low-level driving voltage VSS. The light emitting diode EL emits light with a predetermined brightness by the driving current supplied by the driving transistor DT.

Figure 5:
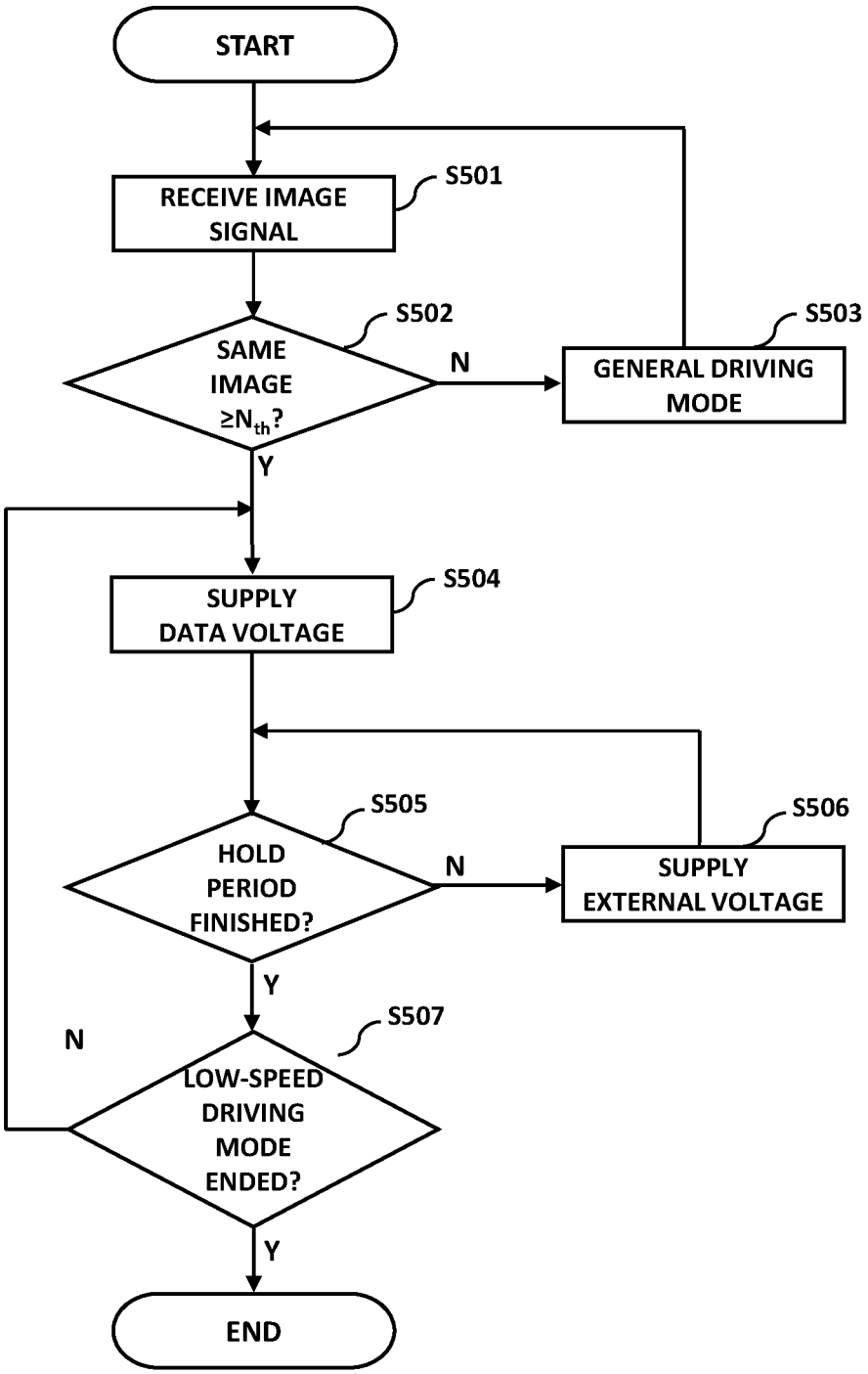
FIG. 5 is a flowchart illustrating a driving method of the OLED device according to an embodiment of the present disclosure.

FIG. 5 is a flowchart illustrating a driving method of the OLED device according to the present disclosure, which is mainly performed by the timing controller 40.

The timing controller 40 receives an image signal DATA from an external system together with various clock signals Hsync, Vsync, DCLK and DE therefrom (S501).

The timing controller 40 stores the image signal in a buffer on a frame basis and checks a variation in the image signal. The timing controller 40 determines whether there is no variation in the image signal between adjacent $N_{th}$ and (N−1)th frames for a predetermined threshold number $N_{th}$ of times. Namely, the timing controller 40 determines whether a constant image signal has been input for a minimum number of times for change to the low-speed driving mode. In other words, the threshold number $N_{th}$ of times may be a condition value for determination as to whether to lower the driving frequency.

The timing controller 40 determines whether the number of times of reception of the same image is greater than or equal to the threshold number N of times (S502). Because the same image signal may be temporarily received, the timing controller 40 operates in a general driving mode unless a predetermined time or more has elapsed (S503).

When the number of times of reception of the same image is greater than or equal to the predetermined threshold number N of times, the timing controller 40 generates control signals to control the gate driver 20, the data driver 30 and the multiplexer 50 such that they operate in the low-speed driving mode. As stated above, when the display device operates in the standby mode or when a user command or an input image is not input for a predetermined time or more, the timing controller 40 may operate in the low-speed driving mode.

The timing controller 40 performs the sampling operation by supplying the data voltage Vdata to the data line of each pixel of the display panel for the refresh frame period in the low-speed driving mode (S504).

The timing controller 40 supplies the voltage Vpark from the separate power supply line to the data line of each pixel for at least one anode reset period in the hold period (S506) until the low-speed driving mode is ended (S507) while determining whether the hold period is finished in the low-speed driving mode (S505).

Figure 6A:
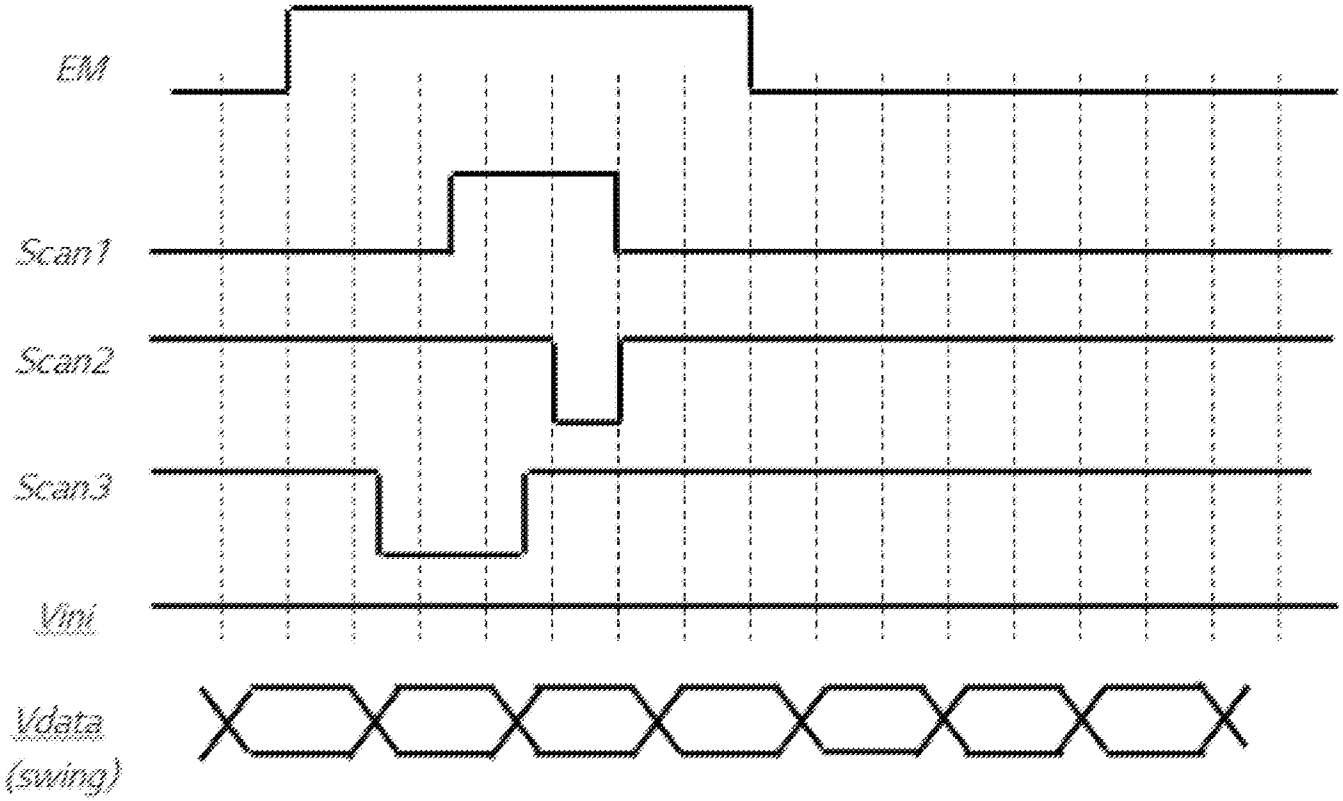
FIG. 6A is a waveform diagram of signals in a refresh period in the low-speed driving mode of the OLED device according to an embodiment of the present disclosure.

FIG. 6A is a waveform diagram of signals in the refresh period in the low-speed driving mode of the OLED device according to the present invention.

As shown in FIG. 6A, for the refresh frame period, when the third scan signal Scan3 has a low logic voltage which is a gate on voltage, the fourth switching transistor T4 is turned on to supply the initialization voltage Vini to the third node N3. Thereafter, the first scan signal Scant is applied to the gate electrode of the third switching transistor T3 as a high logic voltage which is the gate on voltage, thereby causing the third switching transistor T3 to be turned on. As a result, the initialization voltage Vini is transferred from the third node N3 to the second node N2 connected to the gate electrode of the driving transistor DT and then stored in the capacitor Cst. After the lapse of a predetermined time, when the second scan signal Scan2 is applied to the gate electrode of the first switching transistor T1 as the low logic voltage which is the gate on voltage, the first switching transistor T1 is turned on to apply the data voltage Vdata to the first node N1. The third switching transistor T3 is turned off when the first scan signal Scant is changed from the high logic voltage to the low logic voltage, and the first switching transistor T1 is turned off when the second scan signal Scan2 is changed from the low logic voltage to the high logic voltage. In this state, at the time that the light emission control signal EM is changed from the high logic voltage to the low logic voltage which is the gate on voltage, the second switching transistor T2 and the fifth switching transistor T5 are turned on to apply the high-level driving voltage VDD to the source electrode of the driving transistor DT, thereby causing the driving current to be transferred to the anode electrode of the light emitting diode EL.

Figure 6B:
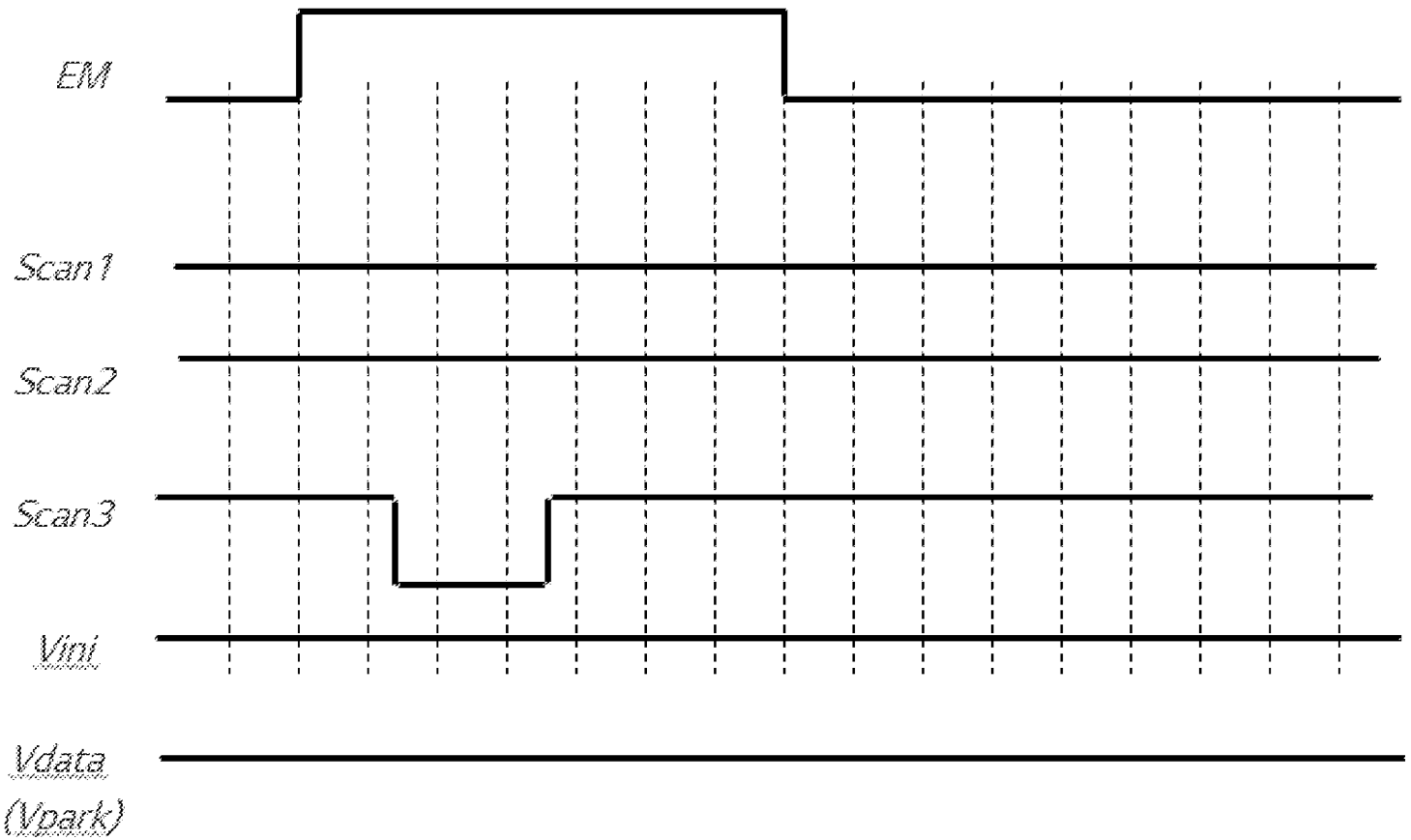
FIG. 6B is a waveform diagram of signals in an anode reset period in the low-speed driving mode of the OLED device according to an embodiment of the present disclosure.

FIG. 6B is a waveform diagram of signals in the anode reset period in the low-speed driving mode of the OLED device according to the present invention. Because the sampling operation is not performed for the anode reset period, the first scan signal Scant is provided as the low logic voltage, which is a gate off voltage, and the second scan signal Scan2 is provided as the high logic voltage which is the gate off voltage. The fourth switching transistor T4 is turned on by the third scan signal Scan3 to initialize the voltage at the third node N3 connected to the drain electrode of the driving transistor DT. At this time, the second switching element SW2 of the multiplexer 50 is turned on by the control signal SEL B from the timing controller 40 to provide the voltage Vpark from the separate power supply line to the data line. In this state, at the time that the light emission control signal EM is changed from the high logic voltage to the low logic voltage which is the gate on voltage, the second switching transistor T2 and the fifth switching transistor T5 are turned on to bypass the voltage Vpark supplied through the data line, so as to reset the anode electrode of the light emitting diode EL.

Figure 7:
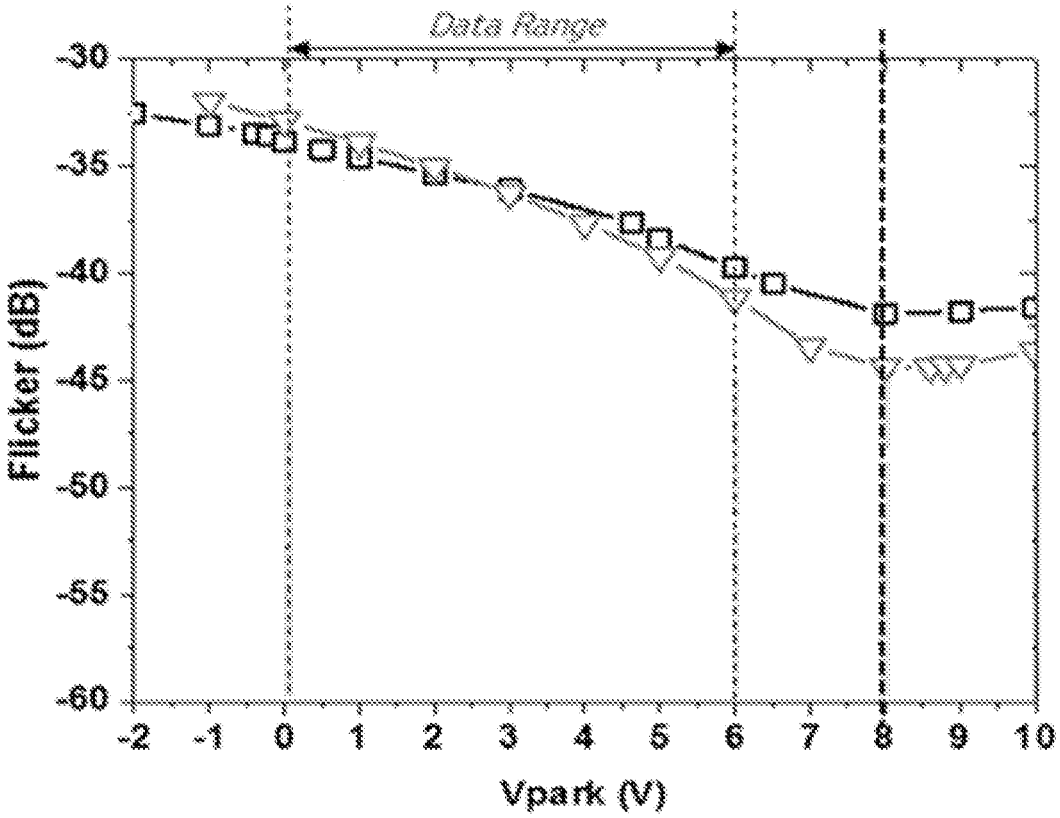
FIG. 7 is a graph illustrating characteristics of flicker in the low-speed driving mode of the OLED device according to an embodiment of the present disclosure.

FIG. 7 is a graph illustrating characteristics of flicker in the low-speed driving mode of the OLED device according to the present disclosure. As stated above, for the anode reset period, the separately supplied voltage Vpark, not the data voltage Vdata, is supplied, so that a data range for removal of the flicker may be increased from 6V to 8V. As shown in this drawing, it can be seen from two experiments sample 1 and sample 2 that the flicker is generated at the minimum when a voltage of at least 8V is supplied for the anode reset period. It can also be seen that the flicker is not reduced any longer even though a voltage of 8V or more is applied. The optimum supply voltage Vpark according to the present invention is greater than a data range (~6V) providable by the data driver 30 and may be 8V in the example of FIG. 7.

Accordingly, it may be possible to remove flicker without raising the output data range of the data driver 30. The value of the optimum supply voltage Vpark is merely exemplary, and the present invention is not limited thereto.

As described above, in the OLED device according to the present disclosure, a picture quality issue, such as flicker, may be improved by supplying the optimum voltage Vpark to the data line in the low-speed driving mode.

As is apparent from the above description, in an OLED device and a driving method thereof according to the present disclosure, a predetermined voltage from a separate power supply line may be applied to a data line for an anode reset period in a low-speed driving mode, thereby making it possible to reduce flicker and improve power consumption.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An organic light emitting display device comprising:

a display panel configured to display an image and comprising a plurality of pixels;

a gate driver configured to supply a gate driving signal to each of the plurality of pixels;

a data driver configured to supply a data voltage to each of the plurality of pixels;

a multiplexer being switched in response to an external control signal to output any one of the data voltage and a voltage supplied from a separate power supply line; and a timing controller configured to control the multiplexer to transfer the data voltage to a data line of each of the plurality of pixels in a refresh period in a low-speed driving mode and transfer the voltage from the separate power supply line to the data line of each of the plurality of pixels for at least one anode reset period in a hold period in the low-speed driving mode, wherein the display panel is driven in the low-speed driving mode when there is no variation in an input image signal for a predetermined number of frames.

2. The organic light emitting display device according to claim 1, wherein the multiplexer comprises:

a first switching element being switched to supply the data voltage to the data line of each of the plurality of pixels for the refresh period; and a second switching element being switched to supply the voltage from the separate power supply line to the data line of each of the plurality of pixels for the at least one anode reset period.

3. The organic light emitting display device according to claim 1, wherein the multiplexer is disposed in the data driver.

4. The organic light emitting display device according to claim 1, wherein the multiplexer is disposed between the data driver and the display panel.

5. The organic light emitting display device according to claim 1, wherein a level of the voltage transferred to the data line of each of the plurality of pixels for the at least one anode reset period is greater than a level of the data voltage.

6. The organic light emitting display device according to claim 5, wherein a level of the voltage transferred to the data line of each of the pixels for the at least one anode reset period is greater than a data range providable by the data driver.

7. A driving method of an organic light emitting display device, the organic light emitting display device comprising a display panel configured to display an image and comprising a plurality of pixels, the method comprising:

determining whether to drive the display panel in a general driving mode or a low-speed driving mode;

supplying a data voltage to a data line of each of the plurality of pixels in a refresh period in the low-speed driving mode; and supplying a voltage from a separate power supply line to the data line of each of the plurality of pixels for at least one anode reset period in a hold period in the low-speed driving mode, wherein determining whether to drive the display panel in the general driving mode or the low-speed driving mode comprises:

receiving an input image signal; and determining whether there is no variation in the input image signal for a predetermined number of frames.

8. The driving method according to claim 7, wherein the organic light emitting display device further comprises a timing controller that stores the input image signal in a buffer on a frame basis and checks the variation in the input image signal.

9. The driving method according to claim 7, wherein a level of the voltage supplied to the data line of each of the plurality of pixels for the at least one anode reset period is greater than a level of the data voltage.

10. The driving method according to claim 7, wherein a level of the voltage transferred to the data line of each of the plurality of pixels for the at least one anode reset period is greater than a data range providable by a data driver of the organic light emitting display device.

* * * * *